US011849283B2

(12) United States Patent
Garudadri et al.

(10) Patent No.: US 11,849,283 B2
(45) Date of Patent: Dec. 19, 2023

(54) MITIGATING ACOUSTIC FEEDBACK IN HEARING AIDS WITH FREQUENCY WARPING BY ALL-PASS NETWORKS

(71) Applicant: THE REGENTS OF THE UNIVERSITY OF CALIFORNIA, Oakland, CA (US)

(72) Inventors: Harinath Garudadri, La Jolla, CA (US); Ching-Hua Lee, La Jolla, CA (US); Kuan-Lin Chen, La Jolla, CA (US); Fred Harris, La Jolla, CA (US); Bhaskar Rao, La Jolla, CA (US)

(73) Assignee: THE REGENTS OF THE UNIVERSITY OF CALIFORNIA, La Jolla, CA (US)

( * ) Notice: Subject to any disclaimer, the term of this patent is extended or adjusted under 35 U.S.C. 154(b) by 0 days.

(21) Appl. No.: 17/760,842

(22) PCT Filed: Sep. 16, 2020

(86) PCT No.: PCT/US2020/051124
§ 371 (c)(1),
(2) Date: Mar. 16, 2022

(87) PCT Pub. No.: WO2021/055513
PCT Pub. Date: Mar. 25, 2021

(65) Prior Publication Data

US 2022/0360911 A1 Nov. 10, 2022

Related U.S. Application Data

(60) Provisional application No. 62/901,287, filed on Sep. 17, 2019, provisional application No. 62/901,013, filed on Sep. 16, 2019.

(51) Int. Cl.
*H04R 25/00* (2006.01)

(52) U.S. Cl.
CPC ..... *H04R 25/453* (2013.01); *H04R 2460/01* (2013.01)

(58) Field of Classification Search
CPC ... H04R 25/00; H04R 25/453; H04R 2460/01
See application file for complete search history.

(56) References Cited

U.S. PATENT DOCUMENTS 6,240,192 B1 * 5/2001 Brennan ..... H04R 25/505 381/314
6,738,486 B2 * 5/2004 Kaulberg ..... H04R 25/453 381/318

(Continued)

OTHER PUBLICATIONS

Kates et at. "Principles of Digital Dynamic-Range Compression." In: Trends Amplif. 2005 Spring; 9(2): 45-76, [online] [retrieved on Nov. 25, 2020 (Nov. 25, 2020)] Retrieved from the Internet< URL: https://www.ncbi.nlm.nih.gov/pmc/articles/PMC4111488/>, entire document, especially, 1-8, 15-38.

(Continued)

*Primary Examiner* — Suhan Ni
(74) *Attorney, Agent, or Firm* — Kaplan Breyer Schwarz, LLP; Stuart H. Mayer

(57) ABSTRACT

A method and system or device such as a hearing aid are provided for processing audio signals. In accordance with the method, an audio signal is received and divided into a plurality of frequency sub-bands. For each of the frequency sub-band signals, the signal is further divided into overlapping temporal frames. Each of the temporal frames are windowed. Frequency warping is performed on each of the windowed frames. Overlap-and-add is performed on the frequency warped frames. The frequency warped sub-bands are combined into a full band to provide a frequency warped signal.

21 Claims, 8 Drawing Sheets

(56) References Cited

U.S. PATENT DOCUMENTS

| | | | | |
|---|---|---|---|---|
| 2004/0190731 | A1* | 9/2004 | Luo | H04R 3/02 381/83 |
| 2009/0147966 | A1 | 6/2009 | McIntosh et al. | |
| 2010/0177917 | A1 | 7/2010 | Van Der Werf | |
| 2010/0202641 | A1* | 8/2010 | Guo | H04R 25/453 381/318 |
| 2013/0170660 | A1 | 7/2013 | Kristensen et al. | |

OTHER PUBLICATIONS

Parfieniuk et al. "Near-Perfect Reconstruction oversampled Non-uniform Cosine-Modulated Filter Banks Based on Frequency Warping and Subband Merging." In: Intl Journal of Electronics and Telecommunications, 2012, [online] [retrieved on Nov. 25, 2020 (Nov. 25, 2020)] Retrieved from the Internet < URL: http://yadda.icm.edu./baztech/element.baztech-article-BWA1 -0053-0025/>, entire document.

* cited by examiner

MITIGATING ACOUSTIC FEEDBACK IN HEARING AIDS WITH FREQUENCY WARPING BY ALL-PASS NETWORKS

CROSS REFERENCE TO RELATED APPLICATIONS

This application claims the benefit of U.S. Provisional Application No. 62/901,013, filed Sep. 16, 2019 and U.S. Provisional Application No. 62/901,287, filed Sep. 17, 2019, the contents of which are incorporated herein by reference.

GOVERNMENT FUNDING

This invention was made with government support under DC015436 awarded by the National Institutes of Health. The government has certain rights in the invention.

BACKGROUND

Improving acoustic feedback reduction hearing aids (HAs) such as those that employ behind the ear, receiver in the canal (BTE-RIC) transducers is an ongoing area of research. An example of such a HA may be found in L. Pisha, S. Hamilton, D. Sengupta, C.-H. Lee, K. C. Vastare, T. Zubatiy, S. Luna, C. Yalcin, A. Grant, R. Gupta, G. Chockalingam, B. D. Rao, and H. Garudadri, "A wearable platform for research in augmented hearing," in Proc. Asilomar Conf. Signals, Syst., Comput. (ACSSC), 2018, pp. 223-227.

In order to compensate for mild to moderate hearing loss, commercial HAs and Open Speech Platform (OSP) provide an average gain of 35-38 dB. In the emerging form factors for advanced HAs and hearables, including conventional BTE-RICs, there is a significant acoustic coupling between the microphones and loudspeakers (called receivers in the telephony and HA communities). This acoustic coupling varies significantly based on surroundings (e.g. hats, scarves, hands, and walls that come in close proximity to the transducers) and can cause the system to become unstable, when the audio content includes characteristic frequencies of the system. This instability results in brief "howling" artifacts and they can be of immense annoyance to the HA users.

Howling artifacts manifest when multiple factors collude to fulfill the magnitude and phase conditions of the Nyquist stability criterion (NSC). Adaptive feedback cancellation (AFC) has been the work horse for breaking NSC to avoid instabilities in many audio applications, including HAs. Typically, the AFC deploys the least mean square (LMS) based approaches to mitigate the magnitude condition in NSC. On the other hand, frequency shifting (FS) and other ad hoc methods mainly deal with the phase condition.

SUMMARY

In one aspect, a system and method are provided for processing audio signals. In accordance with the method, an audio signal is received and divided into a plurality of frequency sub-bands. For each of the frequency sub-band signals, the signal is further divided into overlapping temporal frames. Each of the temporal frames are windowed. Frequency warping is performed on each of the windowed frames. Overlap-and-add is performed on the frequency warped frames. The frequency warped sub-bands are combined into a full band to provide a frequency warped signal.

In one particular embodiment, all-pass filters may be employed to perform the frequency warping. Frequency warping helps in breaking the Nyquist stability criterion and can be used to improve adaptive feedback cancellation (AFC). In more detail, traditional AFC methods rely on breaking the Nyquist stability criterion in the amplitude domain, often using Least Means Square (LMS) approaches. Existing methods for breaking the Nyquist stability criterion in the phase domain include frequency shifting (FS), phase modulation, time-varying all-pass filters to introduce phase shifts, linear predictive coding vocoder.

Frequency warping helps break the Nyquist stability criterion in both the amplitude and phase domains. A combination of LMS based AFC and frequency warping can provide additional stable gains, without resulting in howling side effects due to feedback.

In one particular embodiment, frequency warping is performed after performing dynamic range compression and before AFC in the hearing aid signal processing chain. In another embodiment, frequency warping is performed after noise cancellation and before dynamic range compression in the hearing aid signal processing chain.

Based on informal subjective assessments, distortions due to frequency warping are fairly benign. While common objective metrics like the perceptual evaluation of speech quality (PESQ) and the hearing-aid speech quality index (HASQI) may not adequately capture distortions due to frequency warping and acoustic feedback artifacts from a perceptual perspective, they are still instructive in assessing the proposed method.

Quality improvements with frequency warping have been demonstrated for a basic AFC (PESQ: 2.6 to 3.5 and HASQI: 0.65 to 0.78) at a gain setting of 20; and an advanced AFC (PESQ: 2.8 to 3.2 and HASQI: 0.66 to 0.73) for a gain of 30. From investigations, frequency warping provides larger improvements for basic AFC, but still improves overall system performance for many AFC approaches.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure.

DETAILED DESCRIPTION

The discrete representation of continuous signals and systems is described in A. V. Oppenheim and D. H. Johnson, "Discrete representation of signals," Proc. IEEE, vol. 60, no. 6, pp. 681-691, 1972 (referred to herein after as "Oppenheim and Johnson"), which is incorporated herein by reference in its entirety. It also includes detailed recipes to "transform the frequency axis in a nonlinear manner." This frequency warping is accomplished using an all-pass network.

The techniques shown in Oppenheim and Johnson are employed for hearing aids (HAs) and is referred to as "freping," a portmanteau for frequency warping. A common type of hearing loss is the sloping hearing loss, where the impaired user has a limited ability to perceive high-frequency content. Typically, the intervention is to boost the high-frequency components or move the content to lower frequencies. The former introduces challenges for acoustic feedback control, while the latter facilitates better feedback reduction. Another less common type of hearing loss, but more challenging for providing meaningful interventions is the "cookie bite" hearing loss, wherein it is difficult for the impaired person to perceive mid-frequency content, compared with low- and high-frequency components. As demonstrated below, freping can provide an additional tool to the audiologist for managing individual hearing loss profiles. In particular, freping is shown to mitigate the Nyquist stability criterion (NSC) in conjunction with LMS based AFC approaches.

All-Pass Networks

The all-pass networks described in Oppenheim and Johnson realize a nonlinear mapping of the frequency axis as controlled by a single warping parameter $\alpha$. Let $\omega=2\pi(f/f_s)$ be the normalized angular frequency where f is the original frequency and $f_s$ is the sampling rate. The mapping $\theta$ (.) is:

$$\hat{\omega} = \theta(\omega) = \omega + 2\arctan\left(\frac{\alpha\sin\omega}{1\alpha\cos\omega}\right), -1 < \alpha < 1, \tag{1}$$

where $\hat{\omega}=2\pi(\hat{f}/f_s)$ and $\hat{f}$ is the warped frequency.

Figure 1:
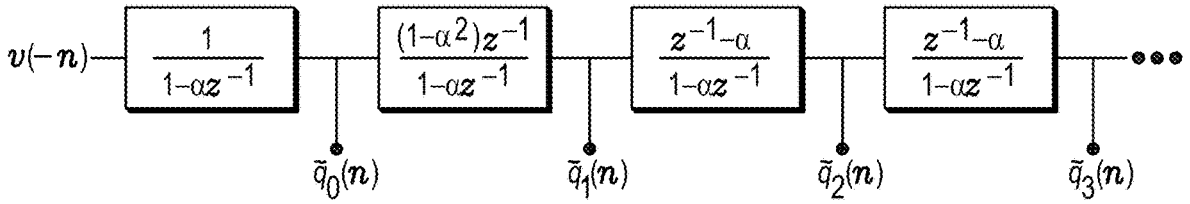
FIG. 1 shows one example of an all-pass network that may be employed for frequency warping.

It can be shown that the nonlinear frequency mapping (1) between the original signal v(n) and the frequency-warped signal q(k) can be achieved by passing the time-reversed signal v(−n) through a linear time-invariant system $H_k(z)$ given as:

$$H_{k(z)} = \begin{cases} \frac{(1-\alpha^2)z^{-1}}{(1-\alpha z^{-1})^2}\left(\frac{z^{-1}-\alpha}{1-\alpha z^{-1}}\right)^{k-1}, & k > 0 \\ \frac{1}{1-\alpha z^{-1}}, & k = 0 \end{cases}, \tag{2}$$

and taking the output $H_k(z)$ at n=0 as q(k). It can thus be implemented as the network shown in FIG. 1. As shown, the first two stages act as (i) low-pass filters when $\alpha$ is positive and the network warps frequencies higher and (ii) high-pass filters when $\alpha$ is negative and the network warps frequencies lower. The remaining stages realize the actual frequency warping based on the bilinear transformation. Note that when $\alpha$=0, it simply passes through the input without any spectral modifications.

The frequency-warped output is given by sampling $\tilde{q}_k(n)$, the output signal at the kth stage, along the cascade chain at n=0, i.e., $\tilde{q}(k)=(0)$. In other words, the input sequence is first flipped and then passed through the network; the last sample of the output sequence at the k-th stage is taken as the k-th sample of the final frequency-warped sequence.

It is worth noting that in practice we need to truncate the signal for the all-pass network to be realizable. Therefore, the warping performance will depend on other factors such as the length and the type of the window function used.

Freping: Real-Time Frequency Warping

Figure 2:
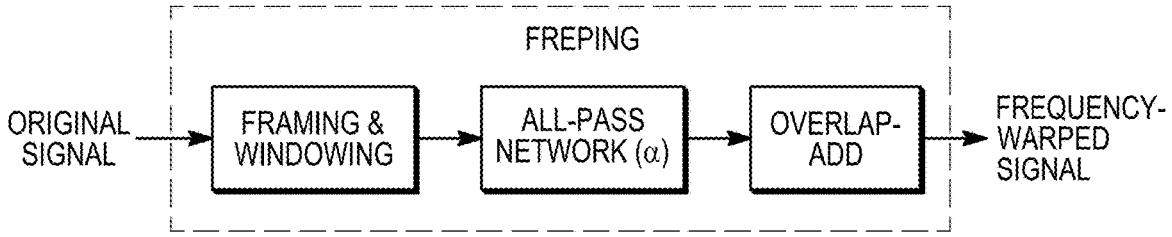
FIG. 2 shows one example of a real-time frequency warping arrangement that employs an all-pass network.

The all-pass networks described above are adopted for real-time frequency manipulations as illustrated in FIG. 2. As shown, the input signal is first divided into overlapping frames and windowed using a proper window function. Each windowed segment then goes through the all-pass network to perform frequency warping with a specified warping parameter $\alpha$. Finally, the overlap-and-add method (described, for instance, in J. B. Allen, "Short term spectral analysis, synthesis, and modification by discrete fourier transform," IEEE Trans. Acoust., Speech, Signal Process, vol. 25, no. 3, pp. 235-238, 1977, which is hereby incorporated by reference in its entirety) is applied to produce the frequency-warped signal.

Figure 3:
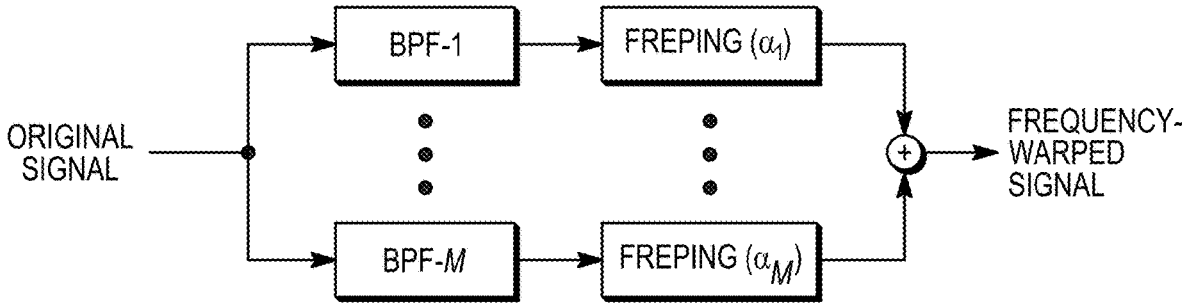
FIG. 3 shows one example of a multichannel real-time frequency warping arrangement that uses band-pass filters (BPFs).

To allow a more flexible way of manipulating spectral characteristics, multichannel freping as illustrated in FIG. 3 may be employed. The system utilizes a set of band-pass filters (BPFs) which divide the input signal into M frequency bands and a set of warping parameters $\alpha=[\alpha_1, \ldots, \alpha_M]^T$. Each band goes through an independent all-pass network with the corresponding warping parameter. The output signals of all the frequency bands are summed up to produce the frequency-warped signal. In many practical situations, it is convenient to reuse the multichannel compression in HA processing for freping. For specific types of hearing loss (e.g. sloping, cookie-bite, etc.), increasing the gain in higher frequency bands aids to fulfill the magnitude condition of NSC and freping hinders the phase condition to occur. Thus, freping provides a way for simultaneously optimizing the parameters of multichannel compression and frequency lowering in HAs for individual hearing loss. In some embodiments, discussed below, we limit ourselves to negative values of a so that freping always shifts spectral content lower.

In another embodiment, the values of alpha $[\alpha_1, \ldots, \alpha_M]^T$ can depend on the values of gain and/or other hearing aid parameters in that particular band. For example, the value of $\alpha_i$ can be made a function of the gain in that particular band.

Freping for Acoustic Feedback Reduction

The benefits of freping for mitigating acoustic feedback along with LMS based AFC are demonstrated below, with the motivation of improving feedback control in hearing aids such as the ear, receiver in the canal BTE-RIC systems referenced above.

Figure 4:
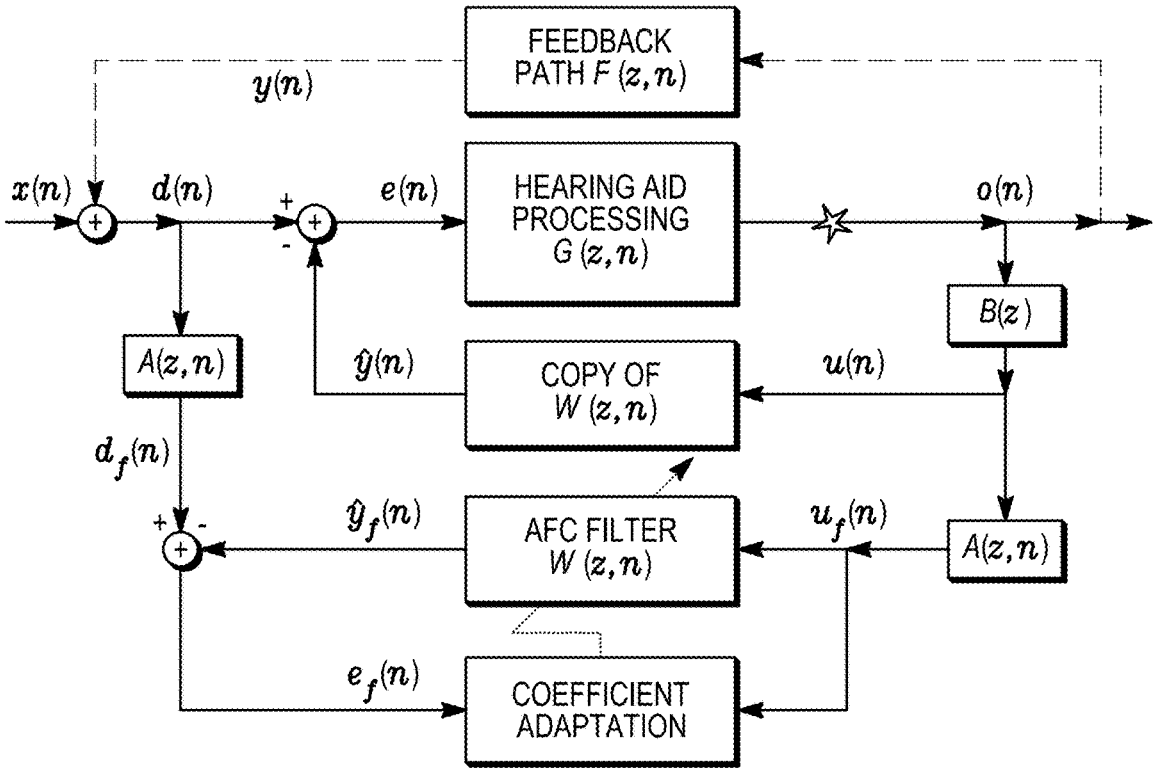
FIG. 4 shows a functional block diagram of one example of an adaptive feedback cancellation (AFC) arrangement placed in parallel with a hearing aid (HA).

In some embodiments, the AFC framework used in C.-H. Lee, B. D. Rao, and H. Garudadri, "Sparsity promoting LMS for adaptive feedback cancellation," in Proc. Europ. Signal Process. Conf. (EUSIPCO), 2017, pp. 226-230, which is depicted in FIG. 4 and is incorporated herein by reference in its entirety, may be employed. Of course, more generally, a wide variety of different AFC arrangements may be employed. As shown, the AFC filter W(z,n), placed in parallel with the HA processing G(z,n), is the transfer function of an L-tap adaptive filter w (n)=[$w_0$(n), $w_1$ (n), . . . , $w_{L-1}(n)^T$ that continuously adjusts its coefficients to capture the time-varying nature of the acoustic feedback path F(z,n). d(n) is the microphone input which contains the clean signal x(n) and the feedback signal y(n) caused by the HA output o(n) passing through the feedback path. $\hat{y}$(n) is the feedback estimate e(n)=d(n)−$\hat{y}$(n) is the feedback-compensated signal. A(z,n) is a time-varying pre-filter to decorrelate the input and output signals based on the prediction error method (PEM) shown in A. Spriet, S. Doclo, M. Moonen, and J. Wouters, "Feedback control in hearing aids," Springer Handbook of Speech Process, pp. 979-1000, 2008. B(z) is a band-limited filter to concentrate on the frequency region where oscillation is more likely to occur.

Typically, LMS-type algorithms are carried out for coefficient adaptation using the pre-filtered signals $u_f$(n) and $e_f$(n) to update the AFC filter w(n) as:

$$w(n+1) = w(n) + \frac{\mu}{L\hat{\sigma}^2(n)+\delta} u_f(n) e_f(n), \tag{3}$$

Where $u_f(n)=[u_f(n), u_f(n-1), \ldots, u_f(n-L+1)]^T$, μ>0 is the step size parameter, δ>0 is a small constant to prevent division by zero, and $\hat{\sigma}^2(n)=\rho\hat{\sigma}^2(n-1)+(1-\rho)(u^2_f(n)+e^2_f(n))$ is the power estimate with a forgetting factor 0<ρ≤1. The update rule (3) is actually the "modified" LMS using the sum method described in J. E. Greenberg, "Modified LMS algorithms for speech processing with an adaptive noise canceller," IEEE Trans. Speech Audio Process, vol. 6, no. 4, pp. 338-351, 1998) and has been widely used in AFC works.

An advanced AFC algorithm, based on the LMS, is the sparsity promoting LMS (SLMS) proposed in C.-H. Lee, B. D. Rao, and H. Garudadri, "Sparsity promoting LMS for adaptive feedback cancellation," in Proc. Europ. Signal Process. Conf. (EUSIPCO), 2017, pp. 226-230, which leverages the sparsity of the feedback path impulse response to achieve faster convergence for improvement. The SLMS update rule includes an additional sparsity promoting term S(n).

$$w(n+1) - w(n) + \frac{\mu}{L\hat{\sigma}^2(n)+\delta} S(n) u_f(n) e_f(n), \tag{4}$$

where S(n)=diag{$s_0$(n), $s_1$(n), . . . , $s_{L-1}$(n)} is an L-by-L diagonal matrix and the diagonal elements are updated according to $s_i$ $$(n) = r_i(n) \Big/ \left(\frac{1}{L}\sum_{j=0}^{L-1} r_j(n)\right)$$

with $r_i(n)=(|w_i(n)|+c)^{2-p}$, (5) where p∈(0,2] is the sparsity control parameter and c>0 is a small positive constant to avoid stagnation of the algorithm.

Without any feedback control mechanism, the frequency responses of the HA processing G($e^{j\omega}$,n) and the feedback path F($e^{j\omega}$,n) form a closed-loop system which exhibits instability that leads to howling. The NSC states that the closed-loop system becomes unstable whenever the following magnitude and phase conditions are both fulfilled:

$$\begin{cases} |G(e^{jw}, n)F(e^{jw}, n)| \geq 1, & \text{(magnitude } cond.) \\ \angle G(e^{jw}, n)F(e^{jw}, n) = m2\pi, & m\in\mathbb{Z} \text{ (phase } cond.) \end{cases} \tag{6}$$

When AFC in employed, it becomes:

$$\begin{cases} |G(e^{jw}, n)F(e^{jw}, n) - \hat{F}(e^{jw}, n))| \geq 1, \\ \angle G(e^{jw}, n)F(e^{jw}, n) - \hat{F}(e^{jw}, n)) = m2\pi, \quad m\in\mathbb{Z} \end{cases} \tag{7}$$

where $\hat{F}(e^{j\omega},n)$=B ($e^{j\omega}$) W($e^{j\omega}$,n) is the estimated feedback path frequency response. The AFC aims at minimizing |F($e^{j\omega}$, n)−$\hat{F}$($e^{j\omega}$,n)| to mitigate the magnitude condition.

It is well-known that the LMS-type algorithms widely used in AFC suffer from biased estimation due to signal correlation. Consequently, the feedback path estimate can be erroneous if decorrelation is not carefully considered. Although the PEM-based pre-filter has provided a certain amount of decorrelation, further improvement is achievable by inserting additional signal processing into the forward path of the HA, usually placed at the location denoted * in FIG. 4. Existing methods include frequency shifting (FS), phase modulation, time-varying all-pass filters to introduce phase shifts, linear predictive coding vocoder, to name just a few. In general, quality degradation might be introduced by these decorrelation methods and thus there is the trade-off between the sound quality and the decorrelation ability for AFC improvement Freping may play a similar role for decorrelation as FS. Freping introduces nonlinear frequency shifts and the distortions appear to be perceptually benign based on informal subjective assessments. As instability is most likely to occur at the high-frequency region, it is reasonable to manipulate the high-frequency content while keeping the low-frequency region intact to avoid degradation in quality. By providing additional decorrelation, freping can reduce the AFC bias and thus a better feedback path estimate can be obtained, thereby improving the magnitude condition in NSC. On the other hand, freping also helps avoid the microphone and receiver signals from remaining continuously in phase with each other. This prevents the phase condition in NSC to hold at the same frequency at two consecutive instants. Consequently, the input and output sounds could not build up in amplitude as effectively. Therefore, the likelihood of instability is reduced.

Note that the approach shown in C. Boukis, D. P. Mandic, and A. G. Constantinides, "Toward bias minimization in acoustic feedback cancellation systems," J. Acoust. Soc. Am., vol. 121, no. 3, pp. 1529-1537, 2007, also utilizes all-pass filters to achieve decorrelation, in which time-varying poles are used for introducing phase shifts. This is different from freping, which manipulates the spectral magnitude as well. Since freping has similarities to FS, we compare them in the following section.

Evaluation

We evaluate the freping system described herein using computer simulations in MATLAB at a sampling rate of 16 kHz. We implemented a 6-band system using a set of BPFs with non-uniform bandwidth whose center frequencies are 250, 500, 1000, 2000, 4000, and 6000 Hz, respectively. Frames of 128 samples with 50% overlap were utilized. The Hann function was applied for windowing. 25 male and 25 female speech signals from TIMIT database were used for simulations.

Figure 5:
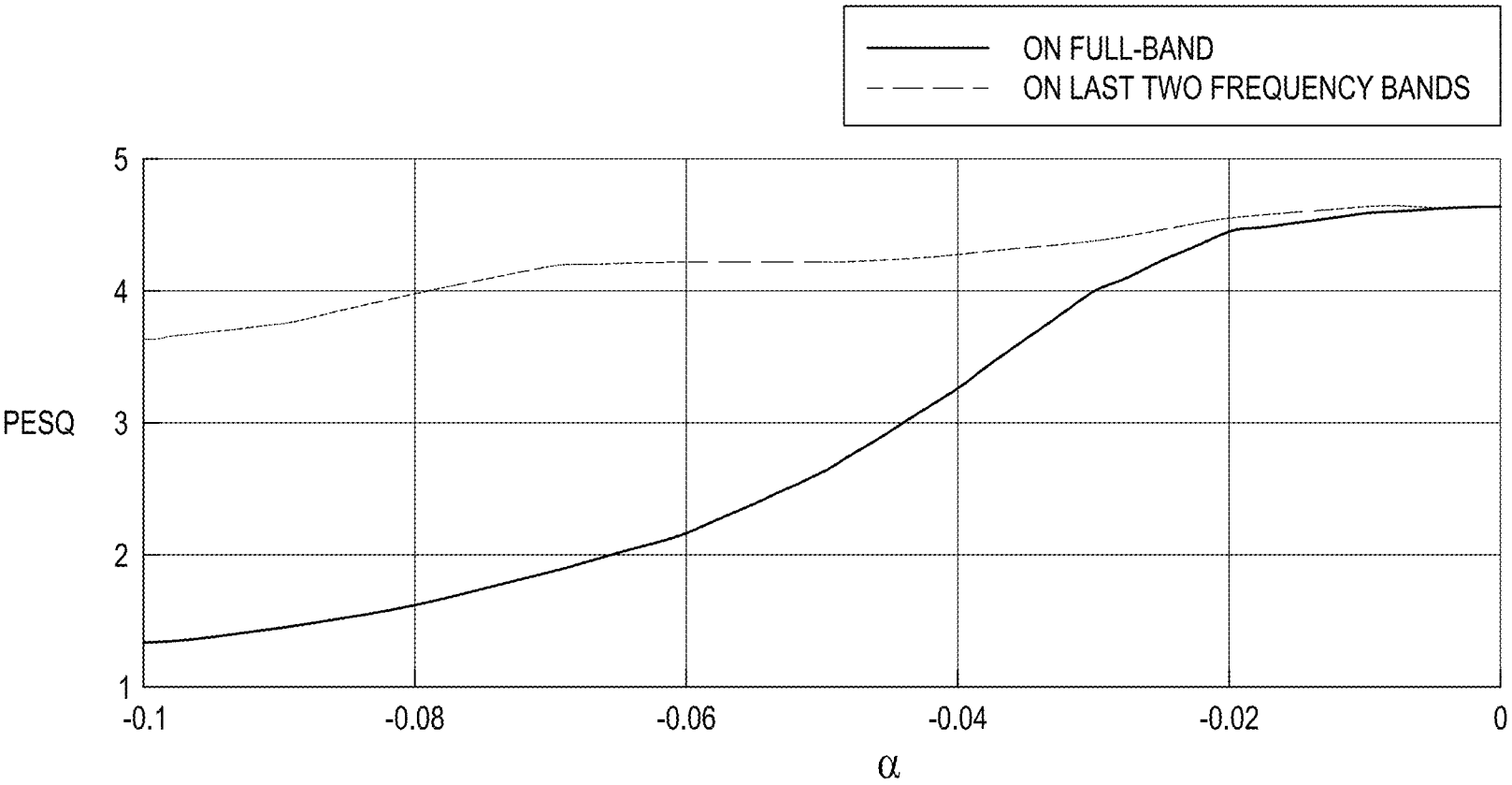
FIG. 5 is a graph showing the average perceptual evaluation of speech quality (PESQ) of the HA as a function of the warping parameter $\alpha$.
Figure 6A:
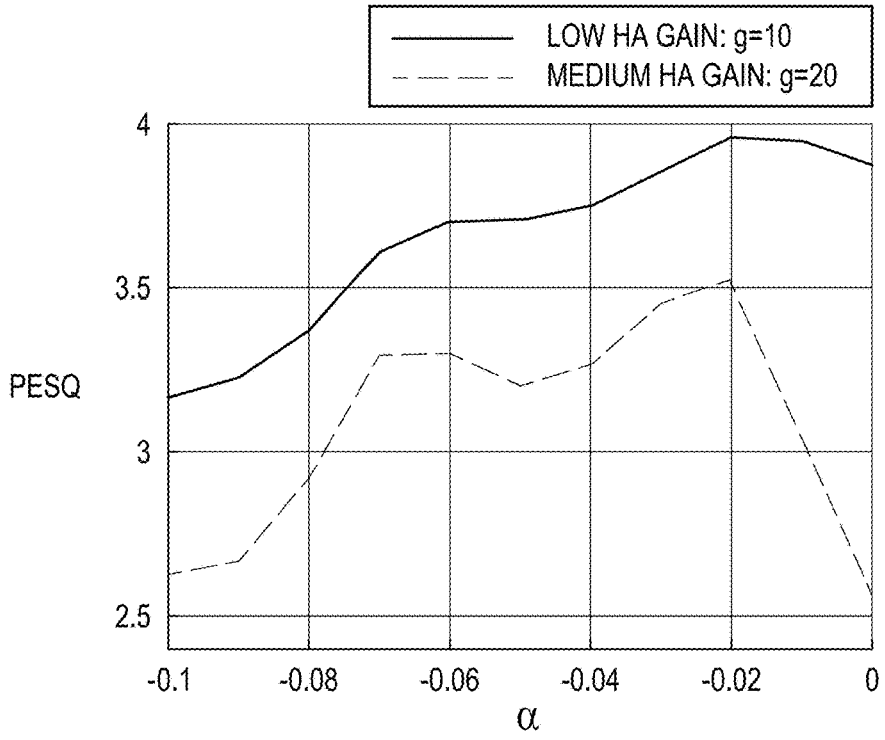
FIG. 6A is a graph showing the average PESQ of the HA output as a function of the warping parameter $\alpha$ for AFC using LMS.
Figure 6B:
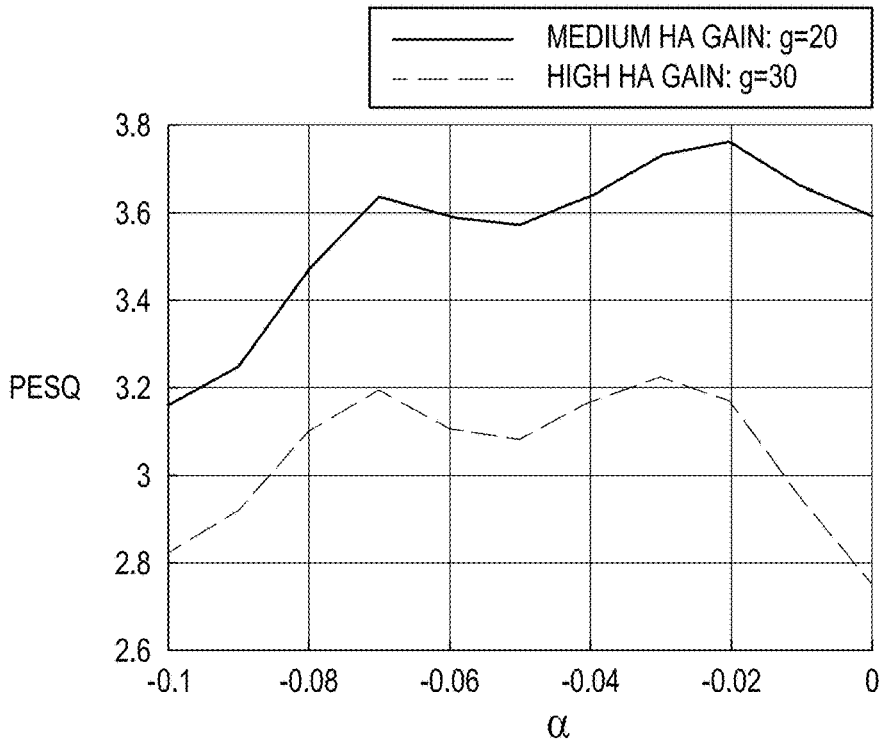
FIG. 6B is a graph showing the average PESQ of the HA output as a function of the warping parameter $\alpha$ for AFC using SLMS.
Figure 7A:
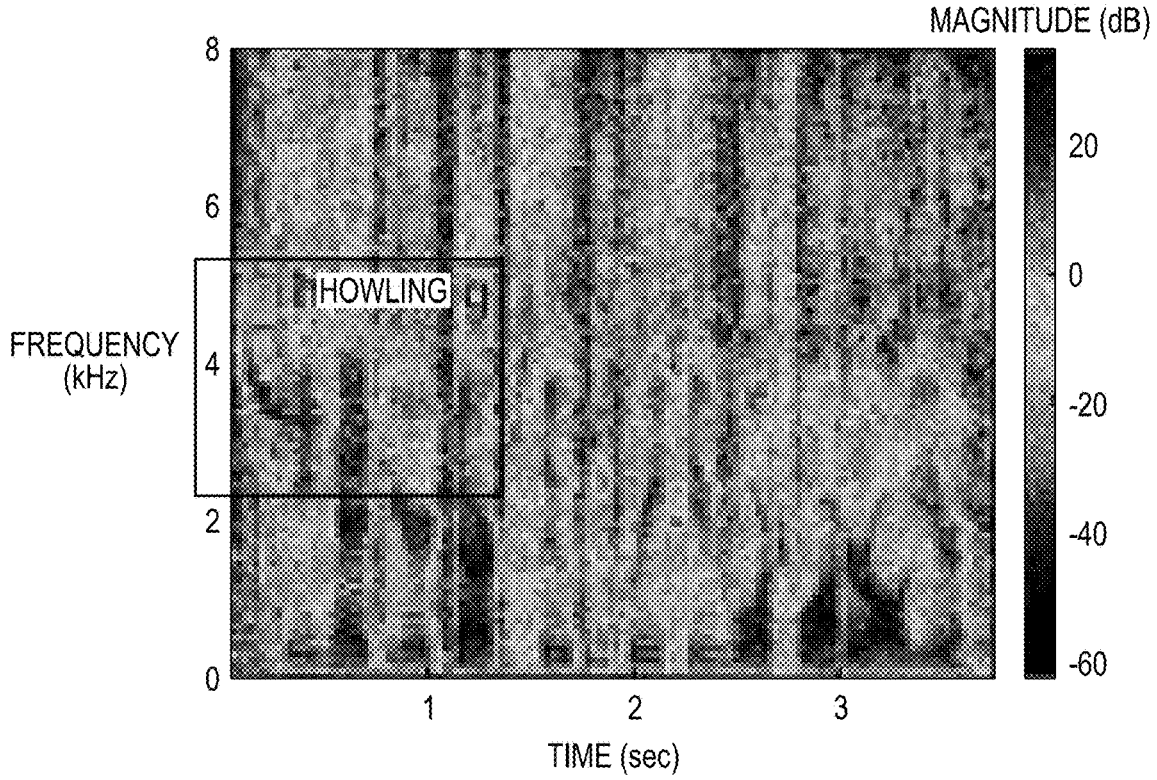
FIG. 7A shows a spectrogram of a feedback-compensated signal with no freping for LMS with an HA gain at 20 and an HASQI score of 0.81.
Figure 7B:
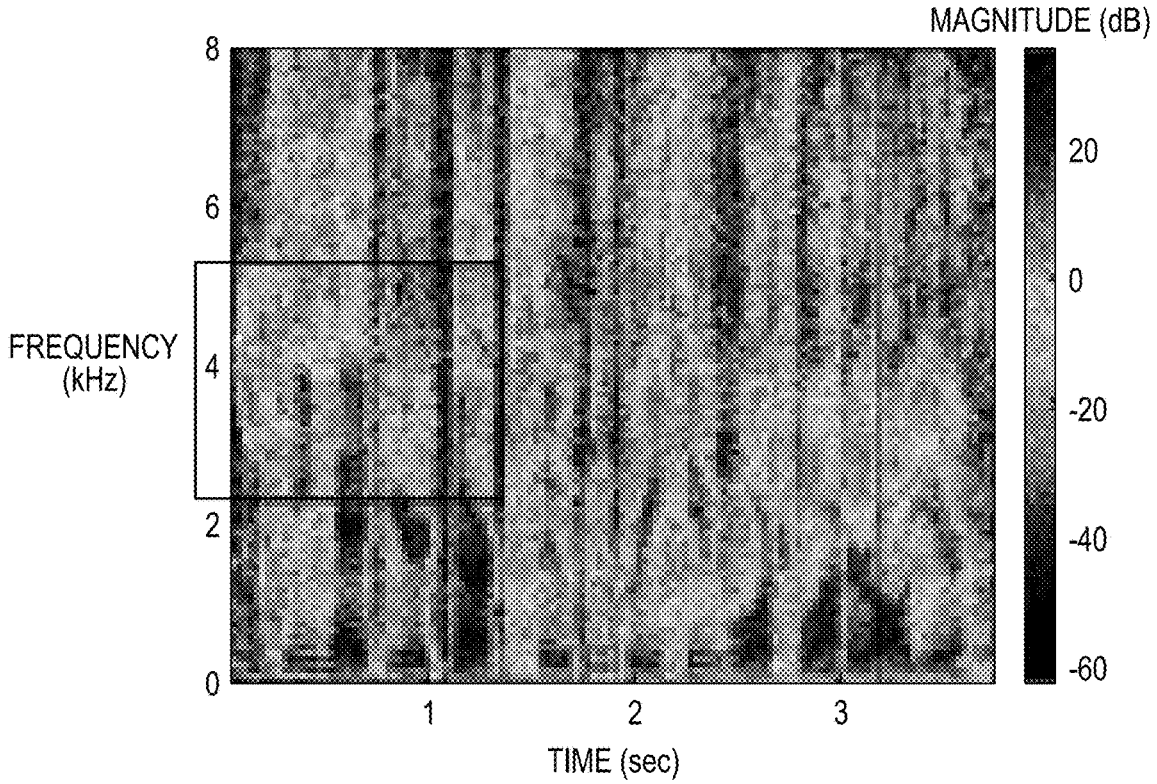
FIG. 7B shows a spectrogram of a feedback-compensated signal with freping enabled ($\alpha$=−0.02) for LMS with an HA gain at 20 and an HASQI score of 0.84.
Figure 7C:
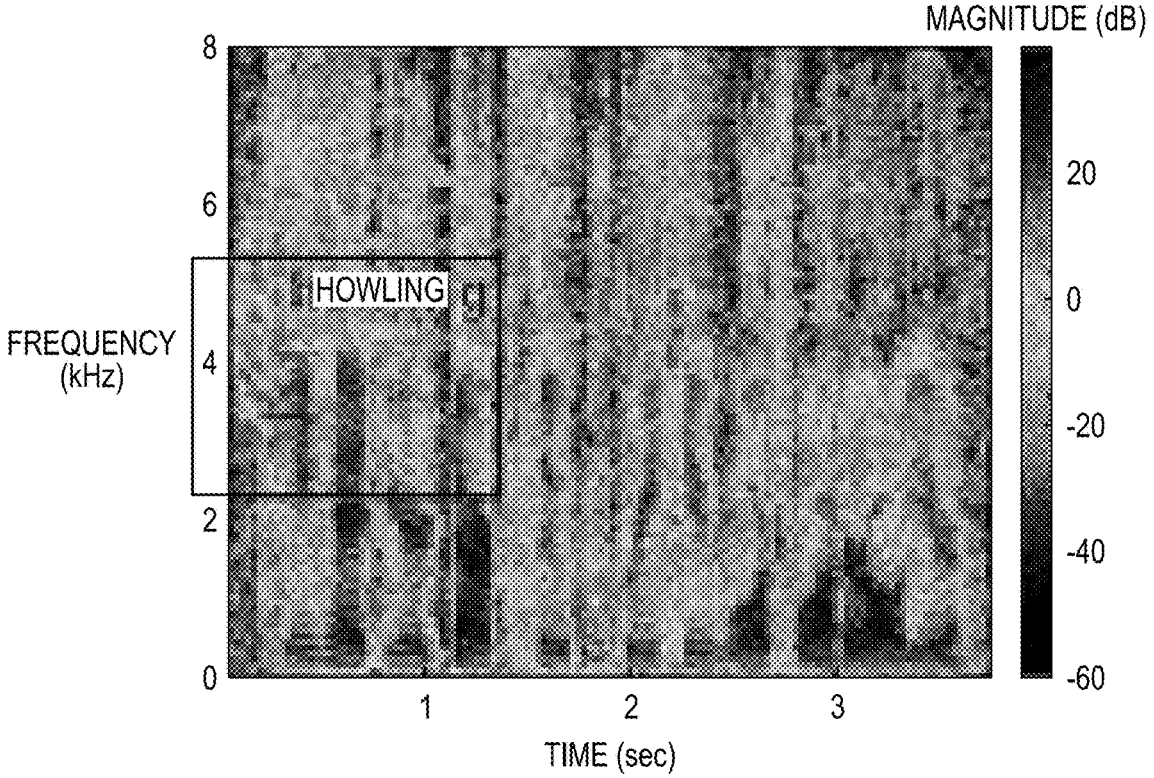
FIG. 7C shows a spectrogram of a feedback-compensated signal with no freping for SLMS with an HA gain at 30 and an HASQI score of 0.79.
Figure 7D:
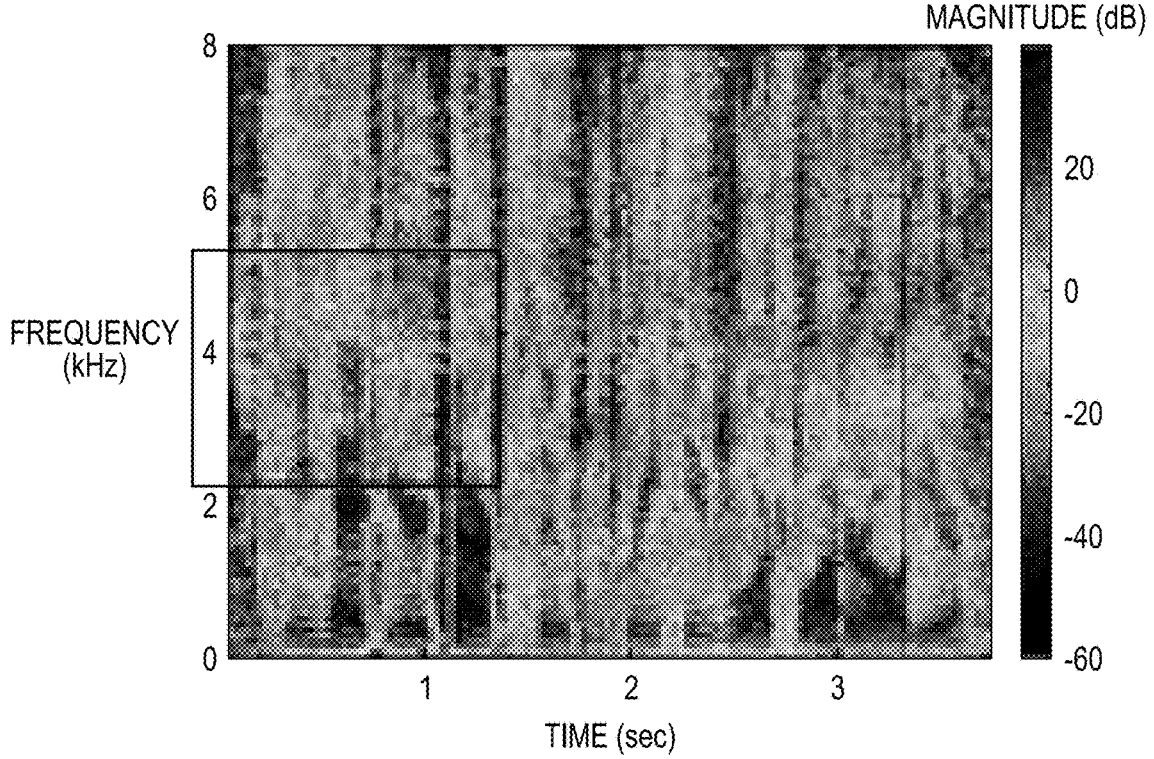
FIG. 7D shows a spectrogram of a feedback-compensated signal with freping enabled ($\alpha$=−0.02) for SLMS with an HA gain at 20 and an HASQI score of 0.82.

In this evaluation we directly performed freping on the speech signal and measured the frequency distortion at the output using the MATLAB implementation of the (wide-band) perceptual evaluation of speech quality (PESQ). The PESQ score gives a good prediction of the mean opinion score and has been suggested for quantifying spectral distortion brought by FS. FIG. 5 shows the average PESQ score of the freping output over the 50 speech files as a function of the warping parameter $\alpha$, for the cases of operating on the full-band ($\alpha=\alpha[1, 1, 1, 1, 1, 1]^T$ and on the last two (high) frequency bands ($\alpha=\alpha[0, 0, 0, 0, 1, 1]^T$). We can see that quality degradation is minor in the latter case.

Now we consider the practical scenario of HA as in FIG. 4. We examine freping with $\alpha=\alpha[0, 0, 0, 0, 1, 1]^T$ on top of the LMS and the SLMS. The experimental setup was as follows. The HA processing $G(z,n)=gz^{-\Delta}$ where g is the HA gain and $\Delta$ is the sample delay chosen to have a total HA latency under 10 msec (from d(n) to o(n)). The feedback path impulse response was measured using a BTE-RIC device with open fitting on a dummy head with a handset placed on the ear—the most challenging scenario for breaking NSC. For the AFC, we used L=100, $\mu=0.005$, $\rho=0.985$, and $\delta=10^{-6}$ for both LMS and SLMS. For the SLMS we used p=1.5 and $c=10^{-6}$ as suggested in C.-H. Lee, B. D. Rao, and H. Garudadri, "Sparsity promoting LMS for adaptive feedback cancellation," in Proc. Europ. Signal Process. Conf. (EUSIPCO), 2017, pp. 226-230. In all simulations, the AFC filter coefficients were initialized as all zeros.

FIGS. 6A-6D show the average PESQ score of the HA output over the 50 speech files for several values of the warping parameter $\alpha$. From the results we can see that when we increase $\alpha$ in magnitude from 0, acoustic feedback gets better controlled, resulting in improved quality. However, further increasing $\alpha$ in magnitude leads to higher spectral distortion and thus the quality drops. This indicates the trade-off between the reduction of feedback artifacts and frequency distortion, and is better seen in the case of a more aggressive gain setting.

We now focus on quantifying the improvement brought by freping in reducing feedback artifacts. In the remaining evaluation process, $\alpha$ was used as suggested by the results in FIGS. 6A-6D. Also from FIG. 5, this choice of $\alpha$ corresponds to an average PESQ of 4.55, which indicates good quality. Furthermore, based on informal subjective assessments, distortions introduced with $\alpha$ in the vicinity of this choice are fairly benign. According to equation (1), for this choice of $\alpha$, the center frequencies of the fifth and sixth frequency bands would move from 4000 and 6000 Hz to 3898 and 5927 Hz, respectively.

We compare the performance with an existing FS method based on the analytical representation of signal using the Hilbert transform. The amount of shift was set to 12 Hz, only applied to the frequency region above 1.5 kHz. When directly performed, this arrangement gives an average PESQ score of 4.47 of the FS output over the 50 speech files, which is comparable but slightly lower than that of the freping result.

For evaluation, we compare the feedback-compensated e(n) with the clean signal x(n), using the hearing-aid speech quality index (HASQI), which has been adopted in prior AFC work. The HASQI score ranges from 0 to 1, where a higher value indicates better quality. FIGS. 7A-7D present examples of spectrograms of the feedback-compensated signal for several cases. We can see that freping effectively reduces the howling components, resulting in improved quality.

Figure 8A:
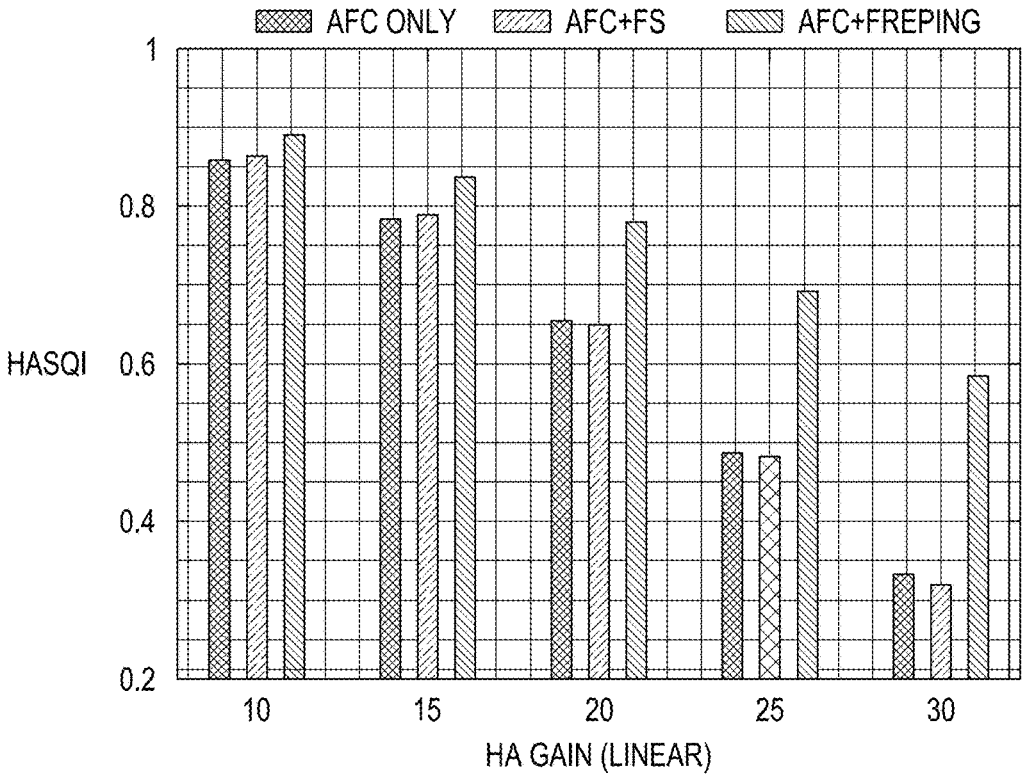
FIGS. 8A and 8B show the HASQI score of the feedback compensated signal for AFC using LMS (FIG. 8A) and SLMS (FIG. 8B) at different HA gains.
Figure 8B:
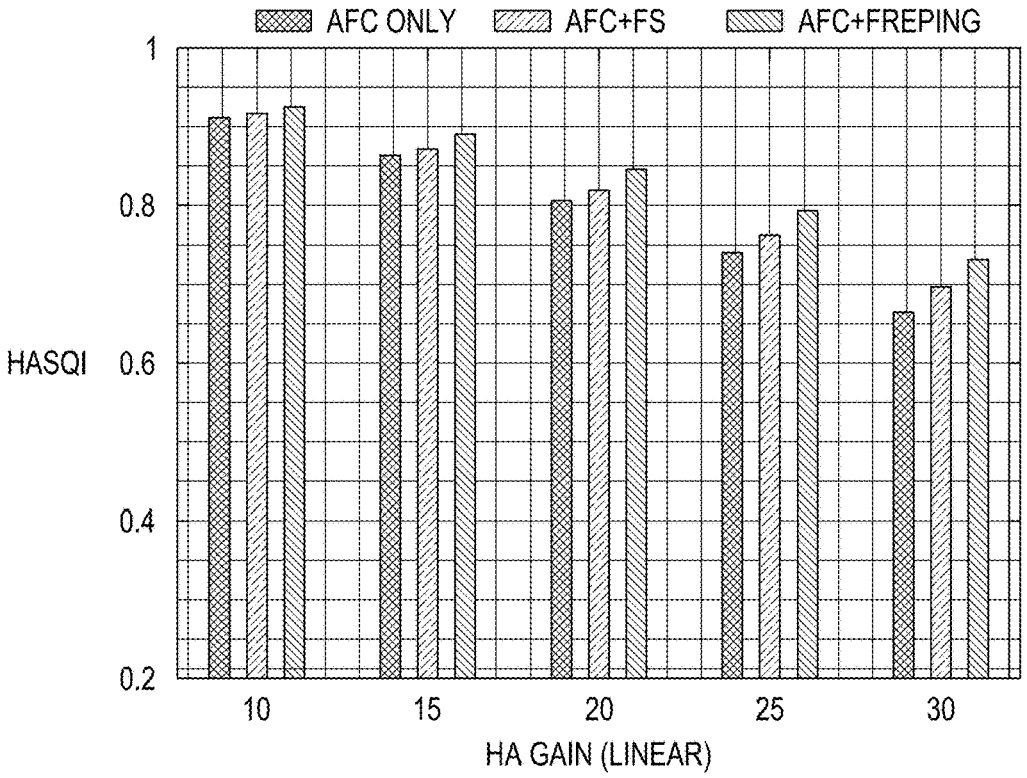

FIGS. 8A-8B demonstrate the advantages of using freping by showing the average HASQI score over the 50 speech files for various gain settings. From the results we see that both the basic (LMS) and advanced (SLMS) AFC algorithms can benefit from freping. This indicates the ability of the proposed frequency warping method to further improve feedback reduction on top of many AFC approaches. Moreover, compared to FS, freping demonstrates better performance under all the gain settings.

Finally, we compare the added stable gain (ASG), which is the additional gain due to feedback control mechanism that the HA can still operate in the stable state, for the cases of AFC, AFC with FS, and AFC with freping. We used the ASG estimation approach proposed in C.-H. Lee, J. M. Kates, B. D. Rao, and H. Garudadri, "Speech quality and stable gain trade-offs in adaptive feedback cancellation for hearing aids," J. Acoust. Soc. Am., vol. 142, no. 4, pp. EL388-EL394, 2017), where a HASQI below 0.8 was considered of unacceptable quality. The results are shown in Table 1, obtained from the average of 5 male and 5 female speech files. We can see that freping can improve the ASG on top of both the basic and advanced AFC algorithms. Compared to the FS, a higher ASG can be achieved by using freping.

TABLE 1

ASG (in dB) comparison.

| AFC algorithms | AFC only | AFC + FS | AFC + freping |
|---|---|---|---|
| LMS | 14.41 | 15.05 | 16.90 |
| SLMS | 17.87 | 18.47 | 19.31 |

In summary, all-pass networks are employed for frequency warping, which is referred to herein as "freping." We described a real-time realization of multichannel freping for use in HAs and its use for breaking the NSC in acoustic feedback control. Experimental results demonstrate quality improvements with freping for basic and advanced AFC approaches. For a desired quality lower bound (e.g. HASQI=0.8), we found ASG improvements of 2.5 and 1.4 dB for LMS and SLMS with freping, respectively.

Example Signal Processing Device

Figure 9:
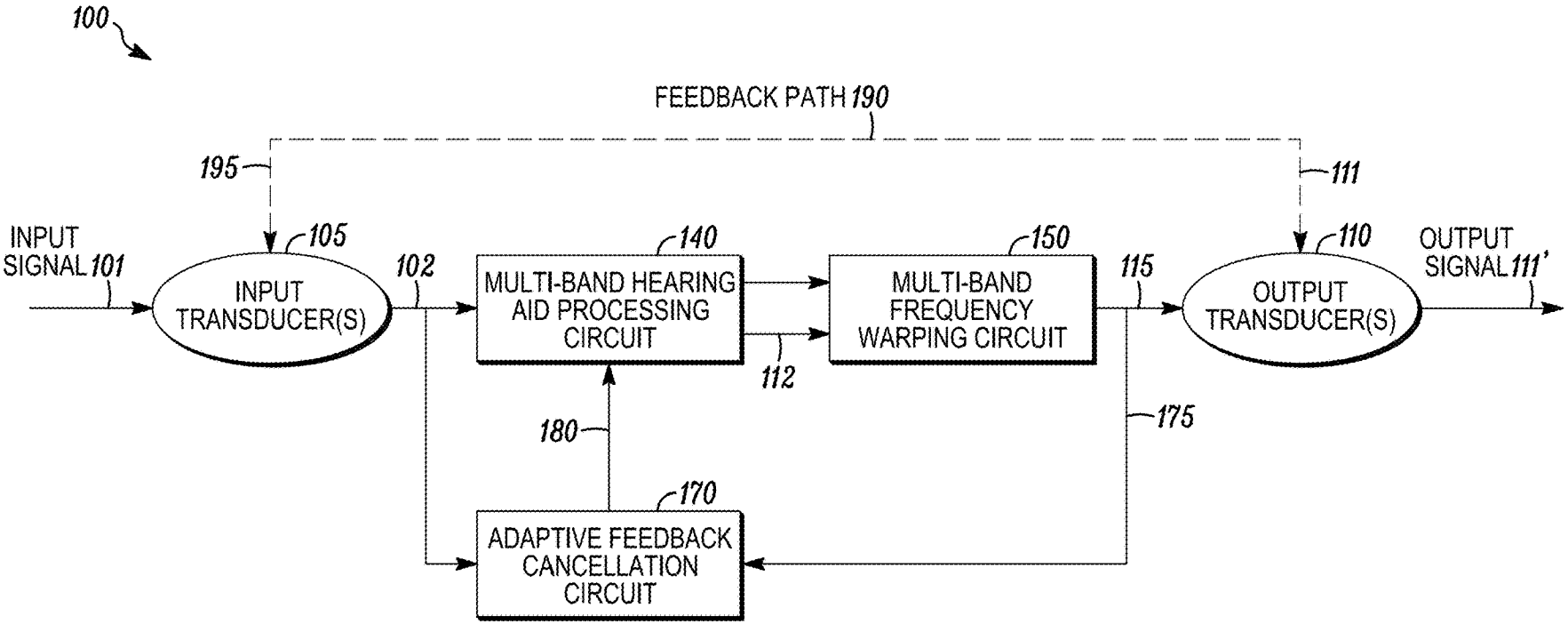
FIG. 9 shows a block diagram of one example of a signal processing device 100 that may employ the techniques described herein.

FIG. 9 shows a block diagram of one example of a signal processing device 100 that may employ the techniques described herein. In one particular example, illustrated in the figure, the signal processing device 100 is a hearing aid, although more generally it may be a signal processing device that is employed in a wide variety of different applications. Signal processing device 100 may comprise at least one input transducer 105 and an output transducer 110. The input transducer 105 may be configured to convert an input 101 to an input signal 102. In one embodiment the input transducer 105 may be a microphone that converts an audible input signal to an electrical audio input signal and the output transducer 110 may be a speaker that converts an electrical audio signal to an audible output signal.

The input to the input transducer 105 may include the audible input signal 101 and feedback 195. The feedback 195 may comprise at least a modified or unmodified portion of an output 111 (desired output 111' is also shown) from the output transducer 110. The output 111 may propagate wirelessly through a feedback path 190. Propagation of the output 111 through the feedback path 190 may cause modification (e.g. attenuation, interference, and/or phase shifting) of at least a portion of the output 111.

The electrical audio input signal 102 from the input transducer 105 is directed to a signal processing circuit, which in the case of a hearing aid is a multi-band hearing aid processing circuit 140. The multi-band hearing aid processing circuit 140 may be configured to at least amplify at least a portion of the electrical audio input signal 102. The output signals 112 from the multi-band hearing aid processing circuit 140 are directed to a multi-band frequency warping circuit 150 such as shown in FIG. 3. The frequency warped signal 115 output from the multi-band frequency warping circuit 150 is directed as input to the output transducer 110. An AFC circuit 170 receives as inputs a portion of the electrical audio input signal 102 from the input transducer 105 and a portion 175 of the frequency warped signal 115 from the multi-band frequency warping circuit 150. The AFC circuit 170 generates an output signal 180 that is provided to the input of the multi-band hearing aid processing circuit 140.

While the techniques described herein have been illustrated for use in a hearing aid processing application, more generally the techniques described herein may be employed in a wide variety of different applications including, without limitation, acoustic echo cancellation, active noise cancellation and acoustic feedback in various audio systems.

Illustrative Computing Environment

Aspects of the subject matter described herein may be described in the general context of computer-executable instructions, such as program modules, being executed by a computer. Generally, program modules include routines, programs, objects, components, data structures, and so forth, which perform particular tasks or implement particular abstract data types. Aspects of the subject matter described herein may also be practiced in distributed computing environments where tasks are performed by remote processing devices that are linked through a communications network. In a distributed computing environment, program modules may be located in both local and remote computer storage media including memory storage devices.

Also, it is noted that some embodiments have been described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

The claimed subject matter may be implemented as a method, apparatus, or article of manufacture using standard programming and/or engineering techniques to produce software, firmware, hardware, or any combination thereof to control a computer to implement the disclosed subject matter. For instance, the claimed subject matter may be implemented as a computer-readable storage medium embedded with a computer executable program, which encompasses a computer program accessible from any computer-readable storage device or storage media. For example, computer readable storage media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). However, computer readable storage media do not include transitory forms of storage such as propagating signals, for example. Of course, those skilled in the art will recognize many modifications may be made to this configuration without departing from the scope or spirit of the claimed subject matter.

Moreover, as used in this application, the terms "component," "module," "engine," "system," "apparatus," "interface," or the like are generally intended to refer to a computer-related entity, either hardware, a combination of hardware and software, software, or software in execution. For example, a component or module may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediary components. Likewise, any two components so associated can also be viewed as being "operably connected", or "operably coupled", to each other to achieve the desired functionality.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments.

The invention claimed is:

1. A method for processing sub-band audio signals, comprising:

receiving an audio signal;

dividing the audio signal into overlapping temporal frames;

windowing each temporal frame;

time-reversing the windowed temporal frames;

for each of the time-reversed windowed temporal frames, passing the time-reversed temporal frame through an all-pass network of a length equal to a length of the time-reversed temporal frame, the all-pass network being configurable with a single parameter alpha;

wherein for positive values of alpha, a first two stages of the all-pass network are configured as low-pass filters and the all-pass network warps frequency content to higher frequencies;

wherein for negative values of alpha, the first two stages of the all-pass network are configured as high-pass filters and the all-pass network warps the frequency content to lower frequencies;

collecting an output of the all-pass network sequentially after passing the frequency warped time-reversed frame;

and performing overlap-and-add on the frequency warped time-reversed temporal frames to provide a frequency warped signal.

2. The method of claim 1, wherein the audio signal comprises a full band signal.

3. The method of claim 1, wherein the audio signal is a sub-band signal.

4. The method of claim 1, wherein the frequency warping is configured with a warping parameter that is a function of gain provided in the sub-band.

5. The method of claim 1, further comprising processing the audio signals to mitigate acoustic feedback in a system having a microphone and a speaker, wherein the frequency warped signal is provided in a forward path of the system.

6. The method of claim 5, further comprising performing adaptive feedback cancellation (AFC) in the forward path using the frequency warped signal.

7. The method of claim 6, wherein the AFC is a least mean square AFC process.

8. The method of claim 1, further comprising performing dynamic range compression on the audio signal prior to performing frequency warping.

9. A hearing aid device, comprising:

a microphone configured to receive an audible input signal from an environment and convert the audible input signal to an electrical audio input signal;

a hearing aid processing circuit configured for processing the electrical audio input signal;

a frequency warping circuit configured to receive an electrical audio signal from the hearing aid processing circuit, the frequency warping circuit being configured to:

divide the electrical audio signal into overlapping frames;

window each temporal frame;

time-reverse the windowed temporal frames;

for each of the time-reversed windowed temporal frames, pass the time-reversed temporal frame through an all-pass network of a length equal to a length of the time-reversed temporal frame, the all-pass network being configurable with a single parameter alpha;

wherein for positive values of alpha, a first two stages of the all-pass network are configured as low-pass filters and the all-pass network warps frequency content to higher frequencies;

wherein for negative values of alpha, the first two stages of the all-pass network are configured as high-pass filters and the all-pass network warps the frequency content to lower frequencies;

collect an output of the all-pass network sequentially after passing the frequency warped time-reversed frame;

perform overlap-and-add on the frequency warped time-reversed temporal frames to provide a frequency warped signal to the speaker;

a speaker configured to receive the frequency warped signal from the multi-band frequency warping circuit and emit an audible output signal into an ear of a user; and an adaptive feedback cancellation circuit located in an acoustic feedback path between an output of the microphone and an input to the speaker, the adaptive feedback cancellation circuit being configured to receive as inputs a portion of the electrical audio input signal from the microphone and the electrical audio signal from the multi-band frequency warping circuit and provide an output as an input to the multi-band hearing aid processing circuit.

10. The hearing aid device of claim 9, wherein the frequency warping circuit includes a chain of all-pass networks for performing the frequency warping.

11. The hearing aid device of claim 9, wherein the frequency warping circuit performs frequency warping with a different warping parameter in at least two of sub-bands.

12. The hearing aid device of claim 9, wherein the frequency warping circuit performs frequency warping with negative values of a warping parameter in each of the sub-bands.

13. The hearing aid device of claim 9, wherein the frequency warping circuit performs frequency warping in each of the sub-bands with a warping parameter that is a function of gain provided in the respective sub-band.

14. The hearing aid device of claim 9, wherein the frequency warping circuit performs frequency warping in at least one of the sub-bands with a warping parameter that is a function of one or more hearing aid parameters.

15. The hearing aid device of claim 9, wherein the frequency warping circuit performs frequency warping in at least one of the sub-bands with a warping parameter that is a function of gain provided in the sub-band.

16. The hearing aid device of claim 9, wherein the audio signal comprises a full band signal.

17. The hearing aid device of claim 9, wherein the audio signal comprises a sub-band signal.

18. The hearing aid device of claim 9, wherein the frequency warping is configured with a warping parameter that is a function of gain provided in the sub-band.

19. The hearing aid device of claim 9, wherein the frequency warping circuit is further configured to perform adaptive feedback cancellation (AFC) in a forward path using the frequency warped signal.

20. The hearing aid device of claim 19, wherein the AFC is a least mean square AFC process.

21. The hearing aid device of claim 9, wherein the frequency warping circuit is further configured to performing dynamic range compression on the audio signal prior to performing frequency warping.

* * * * *